US007233109B2

(12) United States Patent
Geijtenbeek et al.

(10) Patent No.: US 7,233,109 B2
(45) Date of Patent: Jun. 19, 2007

(54) GAS DISCHARGE LAMP

(75) Inventors: Johannes Jacobus Franciscus Geijtenbeek, Eindhoven (NL); Fransiscus Arnoldus Vermeulen, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 68 days.

(21) Appl. No.: 10/501,423

(22) PCT Filed: Dec. 23, 2002

(86) PCT No.: PCT/IB02/05738

§ 371 (c)(1),
(2), (4) Date: Jul. 13, 2004

(87) PCT Pub. No.: WO03/060946

PCT Pub. Date: Jul. 24, 2003

(65) Prior Publication Data

US 2005/0082985 A1 Apr. 21, 2005

(30) Foreign Application Priority Data

Jan. 16, 2002 (EP) ..... 02075159

(51) Int. Cl.
*H01J 17/22* (2006.01)

(52) U.S. Cl. ..... 313/634; 313/640; 313/613; 313/25; 313/573

(58) Field of Classification Search ..... 313/631, 313/634

See application file for complete search history.

(56) References Cited

U.S. PATENT DOCUMENTS

| | | | | |
|---|---|---|---|---|
| 4,621,216 | A * | 11/1986 | Liebe et al. | 313/613 |
| 4,808,876 | A * | 2/1989 | French et al. | 313/25 |
| 5,083,059 | A * | 1/1992 | Graham et al. | 313/631 |
| 5,113,121 | A * | 5/1992 | Lapatovich et al. | 315/248 |
| 5,525,863 | A * | 6/1996 | Kowalczyk et al. | 313/634 |
| 6,147,453 | A * | 11/2000 | Geijtenbeek et al. | 313/640 |
| 6,294,870 | B1 * | 9/2001 | Kawashima et al. | 313/623 |
| 6,844,676 | B2 * | 1/2005 | Alderman et al. | 313/567 |
| 2001/0003411 | A1 | 6/2001 | Honda et al. | |

* cited by examiner

*Primary Examiner*—Don Wong
*Assistant Examiner*—Binh Van Ho

(57) ABSTRACT

A metal halide lamp (101) is described, the lamp being designed such that, when the lamp is operative in a vertical orientation, the location of the salt pool is close to the top of the discharge chamber (5). In an embodiment, the coldest spot is close to the top of the discharge chamber. Means are provided enabling more heat to be supplied to the bottom part than to the upper part. In a lamp assembly (10), comprising a lamp (101) arranged inside a bulb (11), additional heat generating means (90) may comprise a radiation coil (91).

18 Claims, 5 Drawing Sheets

GAS DISCHARGE LAMP

The present invention relates in general to a gas discharge lamp, specifically a HID lamp, more specifically a metal halide lamp.

Gas discharge lamps are commonly known. In general, they comprise a light transmitting vessel enclosing a discharge chamber in a gastight manner, an ionizable filling and a pair of electrodes located opposite each other in the discharge chamber, each electrode being connected to an associated current conductor which extends from the discharge chamber through the lamp vessel to the exterior. During operation, a voltage is applied across said electrodes, and a gas discharge occurs between said electrodes causing a lamp current to flow between the electrodes. Although it is possible to drive an individual lamp within a relatively wide range of operating voltages and/or currents, a lamp is typically designed for being operated at a specific lamp voltage and lamp current and thus to consume a specific nominal electric power. At this nominal electric power, the lamp will generate a nominal amount of light. Since HID lamps are commonly known to persons skilled in the art, it is not necessary to discuss their construction and operation here in more detail.

While a low-pressure gas discharge lamp is typically operated with resonant current, i.e. current having a sine-shaped waveform, a high-pressure discharge lamp is typically operated by supplying commutating DC current. An electronic ballast or driver for such a lamp typically comprises an input for receiving AC mains, a rectifier for rectifying the AC mains voltage to a rectified DC voltage, a DC/DC upconverter for converting the rectified mains DC voltage to a higher DC voltage, a downconverter for converting said higher DC voltage to a lower DC voltage (lamp voltage) and a higher DC current (lamp current), and a commutator for regularly changing the direction of this DC current. The downconverter serves as a current source. Typically, the commutator operates at a frequency in the order of about 100 Hz. Therefore, in principle, the lamp is operated at constant current magnitude, the lamp current regularly changing its direction within a very brief time (commutating periods) in a symmetric way, i.e. an electrode is operated as a cathode during 50% of each current period and is operated as an anode during the other 50% of each current period. This mode of operation will be referred to as square-wave current operation.

Although many of the aspects of the present invention are also applicable to different lamp types, the present invention relates specifically to metal halide lamps with a relatively large aspect ratio, i.e. the ratio of length/diameter is greater than 3 or even 4; conventionally, the aspect ratio is typically in the order of 1–2.

One problem of metal-halide lamps is that their behavior in a horizontal orientation differs from their behavior in a vertical orientation. In a horizontal orientation, the spatial distribution of the particles is almost homogeneous. In a vertical orientation, the spatial distribution of the particles is dependent on the location along the axis of the lamp. This phenomenon, indicated as segregation, is caused by physical effects like convection and diffusion, which are both determined by the atmospheric condition within the lamp. The degree of segregation depends on circumstances like pressure and type of material of the ionizable filling. The segregation effect increases with increasing electrode spacing, i.e. as the aspect ratio is greater.

Since, in a metal-halide lamp, the light is produced by the atoms, segregation has the consequence that the light intensity and light color is not constant anymore along the central axis of the lamp.

It is a general object of the present invention to overcome this problem. More particularly, it is an important objective of the present invention to improve the light-generating capabilities of a metal-halide lamp in its vertical orientation.

In a metal halide lamp, the metal halide is present in the form of an excess amount of salt forming a salt pool. During operation, the salt evaporates, producing molecules which dissociate into atoms which become ionized. Thus, the salt pool is the source of the particles. In a horizontal orientation, the salt pool more or less distributes over the length of the discharge chamber. In a vertical orientation, the salt pool usually is located at the bottom of the discharge chamber, i.e. at one axial end of the discharge chamber.

The present invention is based, inter alia, on the understanding that the particle concentration close to the salt pool is more or less independent of lamp orientation, and is further based on the understanding that, due to segregation, there always is a negative gradient in the particle concentration such that the particle concentration decreases with increasing height. Based on this insight, according to a main aspect of the present invention, a metal-halide lamp is constructed such that the salt pool is located at the top end of the discharge chamber.

These and other aspects, features and advantages of the present invention will be further explained by the following description with reference to the drawings, in which:

FIG. 1 schematically shows an embodiment of a metal-halide lamp;

FIG. 2 schematically shows a lamp assembly;

Figure 1:
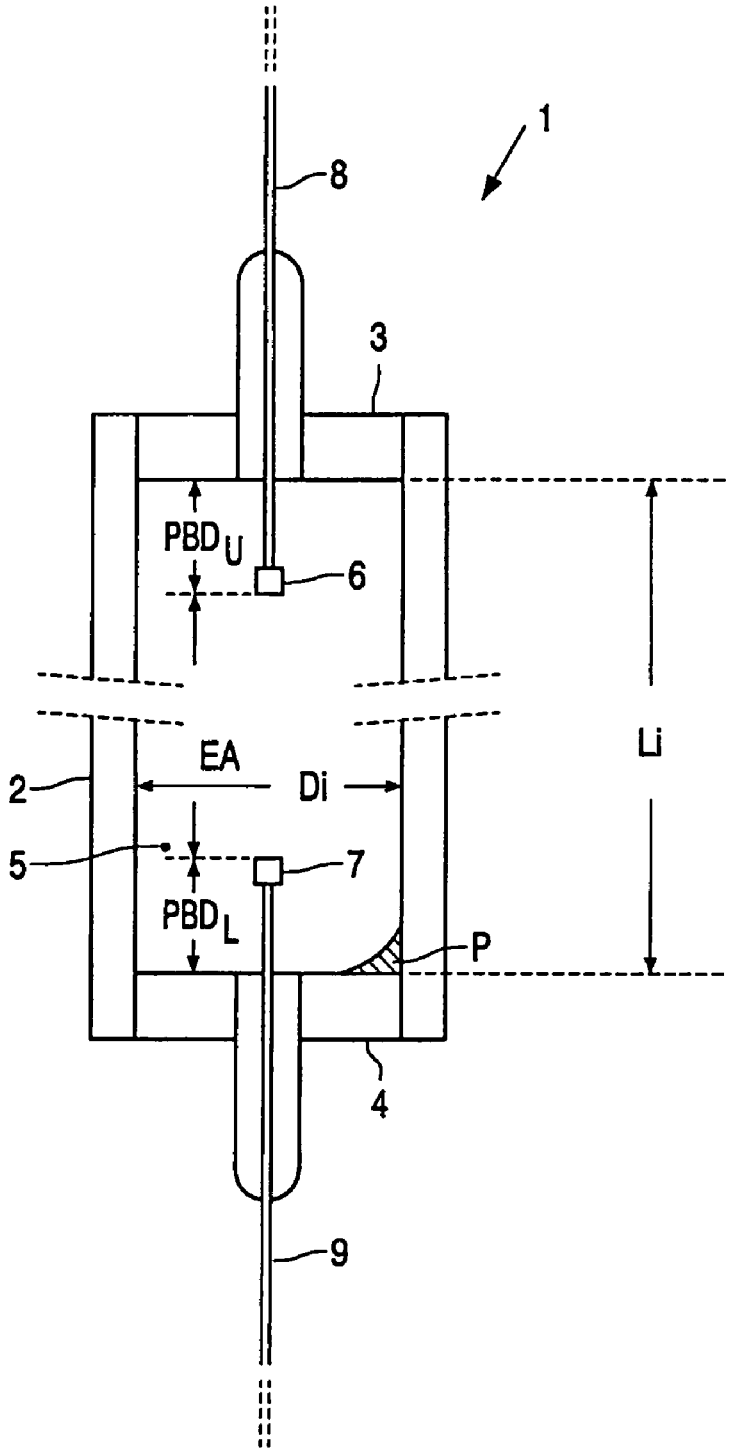

FIG. 1 schematically shows a possible embodiment of a metal-halide lamp, generally indicated by means of reference numeral 1. The lamp 1 comprises a translucent vessel 2, typically of circular cylindrical shape and having an internal diameter Di. Although not essential in the context of the present invention, the vessel 2 is preferably made from ceramic material; alternatively, the vessel 2 could be made from quartz or quartz glass. Ceramic material is herein understood to be one of the following materials: monocrystalline metal oxide (for example sapphire), densely sintered polycrystalline metal oxide (for example $Al_2O_3$, YAG), and densely sintered polycrystalline metal nitride (for example AIN). At its longitudinal ends, the vessel 2 is closed in a gas-tight manner by plugs 3, 4 of a compatible material, preferably also ceramic or quartz. The vessel 2 and the plugs and/or end caps 3, 4 enclose a discharge chamber 5 having a diameter equal to the internal diameter Di of the vessel 2 and having an axial length Li determined by the distance between the end caps 3 and 4. An aspect ratio AR is defined as the ratio Li/Di.

Inside the discharge chamber 5, two electrodes 6, 7 are arranged at a mutual distance EA, and substantially aligned with the central axis of the vessel 2. In a gas-tight manner, electrode conductors 8, 9 extend from the electrodes 6, 7 through the end caps 3, 4, respectively. Typically, the electrodes 6, 7 will be made from a material differing from the material of the electrode conductors 8, 9; by way of example, the electrodes 6, 7 may be made from tungsten. As will be clear to a person skilled in the art, the electrodes 6, 7 are provided with coils wound around their tips, but this is not illustrated in detail in FIG. 1.

Inside the discharge vessel 2, i.e. in the discharge chamber 5, an ionizable filling is arranged. The filling typically comprises an atmosphere comprising a substantial amount of mercury (Hg). Typically, the atmosphere also comprises elements like xenon (Xe) and/or argon (Ar). In a practical example, where the overall pressure inside the discharge vessel 2 is in the order of 1–2 atm, argon and xenon may be present in the ratio 1:1. In another practical example, where the overall pressure is in the order of 10–20 atm, the discharge chamber may contain mercury and a relatively small amount of argon. In the following, said examples of commercially available lamps will be indicated as relatively low pressure lamp and relatively high pressure lamp, respectively.

The discharge vessel 2 also contains one or more metal-halide salts. Although the salts may comprise bromides or other halides, the salts typically comprise iodides. Typical examples of such possible salts are lithium iodide, cerium iodide, sodium iodide. Other salts are possible too. The salts are present in excess and form a pool.

In operation, a discharge will extend between the electrodes 6, 7. Due to the high temperature of the discharge, said salts will evaporate from the pool, after which they will be dissociated and produce light. The color of the light produced is different for different salts; for instance, the light produced by sodium iodide is red while the light produced by cerium iodide is green. Typically, the lamp will contain a mixture of suitable salts, and the composition of this salt mixture, i.e. the identity of said salts as well as their mutual ratio, will be chosen such as to obtain a specific desired overall color.

Figure 2:
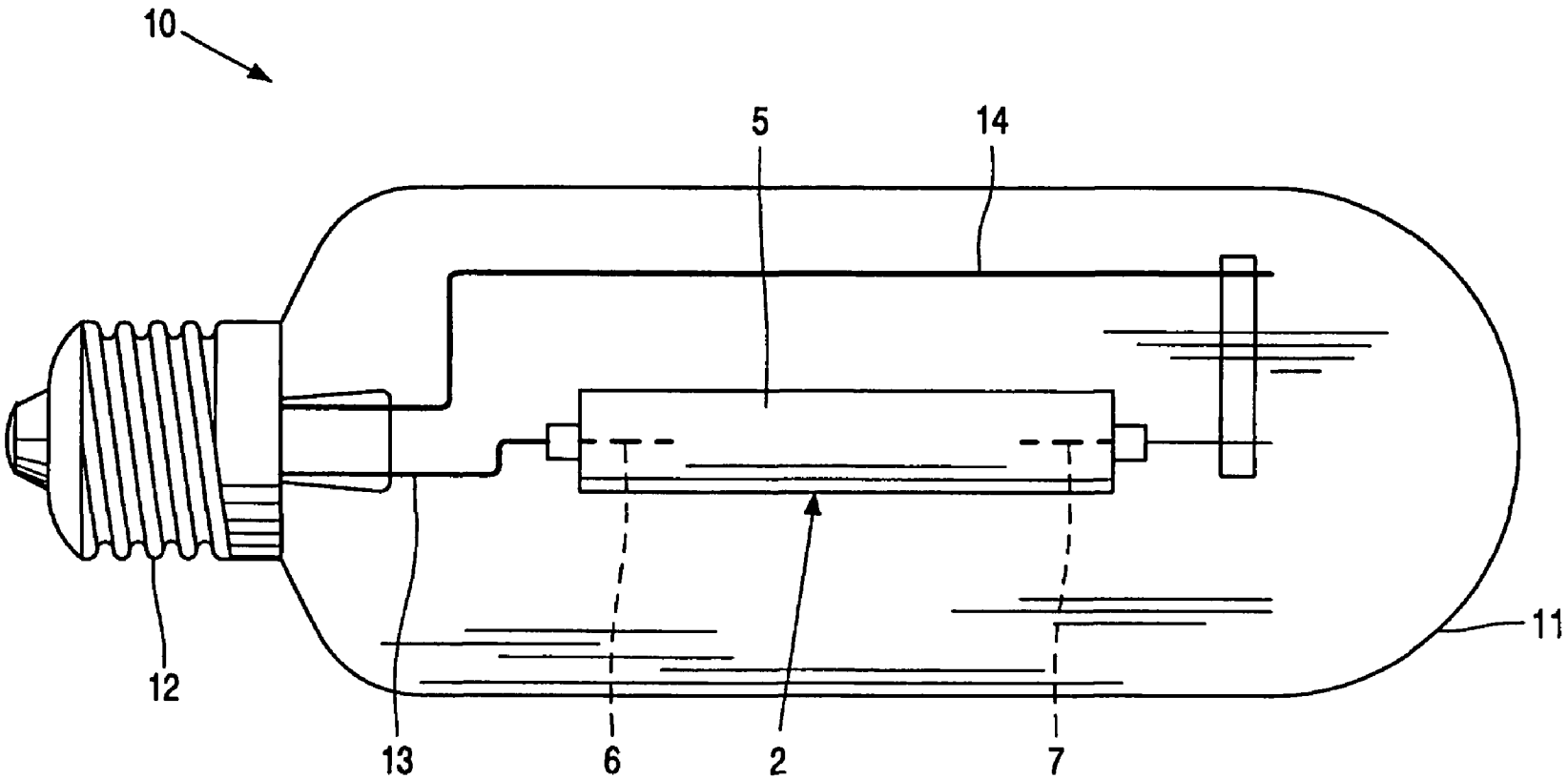

FIG. 2 shows the lamp 1 mounted in a bulb or envelope 11 having at one end thereof a standard lamp connection cap 12, suitable for screwing into a standard lamp holder (not shown). The lamp 1 is axially aligned with the bulb 11. The lamp 1 is supported by two supportive conductors 13 and 14, which are suitably connected to the electrode conductors 8 and 9, respectively, and electrically connected to electric contacts of the cap 12.

The combination of lamp 1 and its surrounding bulb 11 will hereinafter be referred to as lamp assembly 10.

Figure 3:
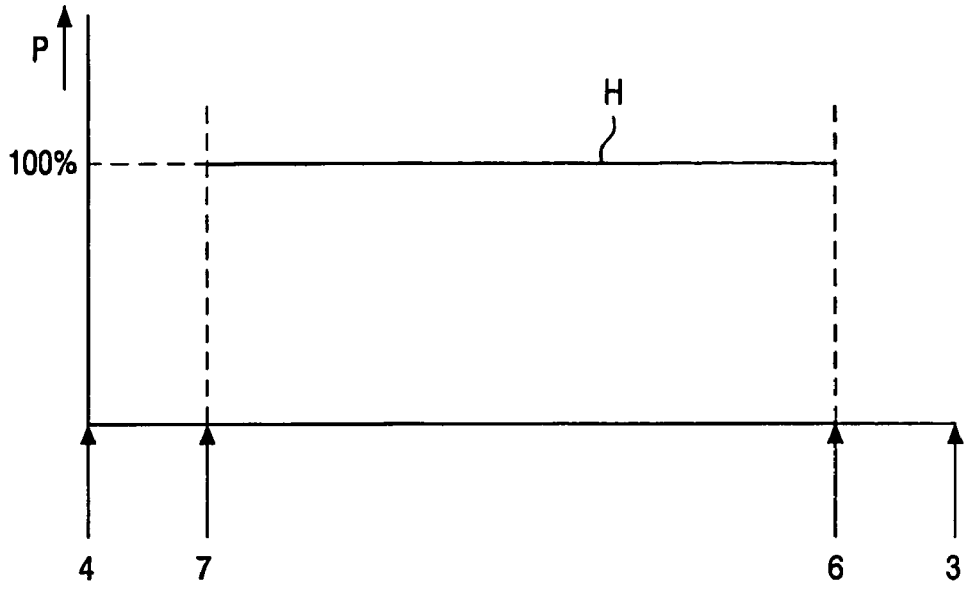
FIG. 3 is a graph illustrating the particle distribution along the central axis of a lamp in its horizontal orientation.

FIG. 2 illustrates the lamp assembly 10 in a horizontal orientation, i.e. the central axis of the discharge vessel 2 is positioned horizontally. In this orientation, a discharge arc between the electrodes 6 and 7 will have its arc axis directed horizontally. In this orientation, the spatial distribution of particles inside the discharge vessel 2, along the central axis thereof, will be substantially homogeneous, as illustrated by the horizontal line H in FIG. 3. FIG. 3 is a graph illustrating the partial particle pressure or particle concentration as a function of the location along the central axis of the discharge vessel 2. This position is represented by means of the horizontal axis of FIG. 3 where, by way of reference, the position of end caps 3 and 4 and electrodes 6 and 7 are indicated. The graph relates only to the space between the electrodes 6 and 7, i.e. the location of the arc.

Although in practice the composition of the mixture of the ionizable components of the evaporated salt mixture may vary such that the partial pressure of each individual ionizable component will have a different value, this is not represented in FIG. 3. It is noted that, for the present discussion, the exact value of the partial component pressure is not relevant, therefore the vertical axis of FIG. 3 does not show any scale marks. Only at the level of the said horizontal line H, the value 100% is marked. This value corresponds to the "maximum" value a partial component pressure reaches along the lamp axis. Thus, since all partial component pressures are substantially constant (and therefore equal to the maximum value) along the lamp axis, all mutually different partial pressures are represented in FIG. 3 by only one horizontal line H.

It is important to realize that the light-emitting properties of the lamp 1 at a certain location in the lamp depend on the partial pressure of the ionizable components at that location. The higher the partial pressure of a specific component at said certain location, the more light will be produced having the specific spectral properties corresponding to this specific component. Thus, if the partial pressure of the components along the central axis of the lamp is constant, as illustrated by line H in FIG. 3, also the light-emissive properties of the lamp 1 as a whole are constant along the central axis of the lamp 1, i.e. constant light intensity and constant color.

Figure 4:
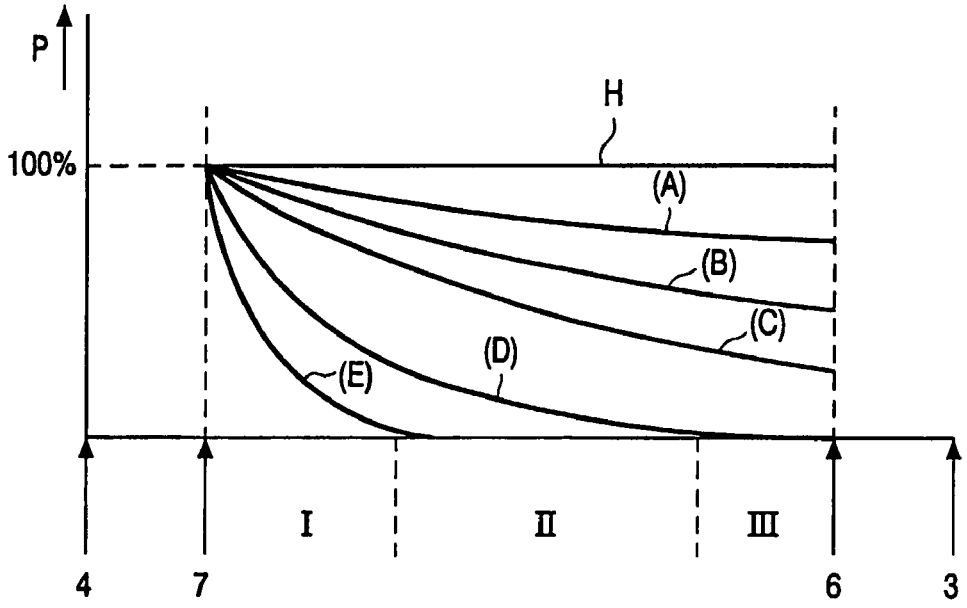
FIG. 4 is a graph illustrating the particle distribution along the central axis of a lamp in its vertical orientation, for a lamp with a salt pool located at the bottom.

FIG. 4 illustrates the problems of segregation associated with a vertical orientation of the lamp 1. FIG. 4 is comparable to FIG. 3, and by way of reference the horizontal line H corresponding to the horizontal orientation of the lamp 1 is shown as well. Otherwise, FIG. 4 relates to a vertical orientation of the lamp 1, where a burning arc will have a vertically directed arc axis. In the example shown, it is assumed that second electrode 7 is the lower electrode while first electrode 6 is the upper electrode, corresponding to the illustration of FIG. 1. Curves (A)–(E) show that in this condition the particle pressure is not constant but depends on the location. More particularly, the particle pressure decreases with increasing vertical distance from the bottom electrode 7. This phenomenon is a natural phenomenon, caused by a combination of convection and diffusion occurring within the discharge chamber 5, as will be clear to a person skilled in the art.

The effect of segregation may be more or less severe, depending on circumstances. As a general rule, the effect is more severe as the pressure in the discharge chamber 5 is higher. For instance, curve (A) might relate to a relatively low pressure situation in the order of 1–2 atm, while curve (E) might relate to a relatively high pressure situation in the order of 10–20 atm.

Furthermore, the effects of segregation tend to be most noticeable at one end of the lamp (the upper end in the example shown). In this example, the particle concentrations are virtually "normal", i.e. identical to the horizontal condition, close to the lower electrode 7, which is illustrated by the fact that, at the location of lower electrode 7, all curves intersect at the horizontal line H. At other locations, the particle concentrations deviate from their value close to the lower electrode 7, the deviation increasing as the distance from the lower electrode 7 increases, ending at a maximum deviation close to the upper electrode 6. As a general rule, the effect is more severe as the length Li of the discharge chamber 5 is greater.

Furthermore, the severity of segregation is not equal for different elements within the same lamp. For instance, the segregation in the case of cerium iodide is more severe than the segregation in the case of sodium iodide, so that curve (B) might be representing cerium iodide while curve (A) might be representing sodium iodide. However, this does not necessarily mean that the partial pressure of sodium iodide is always higher than the partial pressure of cerium iodide.

One effect of segregation relates to the efficacy of the lamp 1. As the amount of light produced within a certain unit of space is proportional to the amount of light generating atoms within such a unit of space, it will be clear that segregation causes a reduction in light output of the lamp as a whole on the one hand, and on the other hand segregation causes an uneven distribution of the light intensity along the length of the lamp. More particularly, the higher portions of the lamp will produce less light than the lower portions of the lamp.

The above already applies if a lamp contains only one light generating substance. In the case of a mixture of substances, the above applies also, but to a different extent for the various components in the mixture, as explained hereinabove. Since the overall color impression of the light produced by the lamp depends on the light contributions from the various components of the mixture, segregation causes a change of the color of the light produced by the lamp as a whole on the one hand, and on the other hand segregation causes an uneven color distribution along the length of the lamp.

This effect will be most noticeable at the upper extremity of the lamp 1, while the situation at the lower extremity of the lamp seems normal. As indicated in FIG. 4, at the lower electrode 7 the relative partial pressures of the light-producing components substantially corresponds to the situation of horizontal orientation, and the generated light is in conformity with design expectations. In contrast, at the upper electrode 6, the relative partial pressures deviate from the situation of horizontal orientation, the extent of deviation being different for different components. For instance, in the case of a lamp containing a mixture of sodium iodide and cerium iodide in a predetermined ratio, the amount of reddish light produced by the sodium iodide will, at the upper electrode 6, be reduced because of the reduced concentration of sodium atoms near the upper electrode 6 while also the amount of greenish light produced by the cerium iodide will be reduced because of the reduced concentration of cerium atoms. Since the reduction of greenish light exceeds the reduction of reddish light, the overall impression of the color of the light produced around the upper electrode 6 will have shifted to reddish. Furthermore, the overall light intensity around the upper electrode 6 will have been reduced.

Curves (D) and (E) show that the severity of segregation can be such that a certain amount of space around the upper electrode 6 is virtually void of any light-producing atoms. What remains is a background glow produced by the mercury buffer gas.

The present invention is based on the recognition that, during operation, a pool of melted salt will be present inside the discharge chamber, and that the particle concentration close to the salt pool (vapor pressure) does not depend (or only to a small degree) on the orientation of the lamp, although the location of the salt pool may depend on the orientation of the lamp. Usually, when the lamp is in a vertical orientation, the salt pool is located close to the bottom of the discharge chamber. Since the particle concentration decreases with increasing height (i.e. increasing vertical distance from the bottom of the discharge chamber), the particle concentration in a vertical orientation is lower than the particle concentration in a horizontal orientation, which effect is stronger at higher locations. The present invention is further based on the recognition that, although in prior art lamps the salt pool is located close to the bottom of the discharge chamber, such is not necessary, because the location of the salt pool is not only determined by gravity but mainly by temperature. More particularly, the salt pool will undergo condensation at the coldest spot of the discharge chamber.

Based on this insight, the present invention proposes to design a lamp such that, when the lamp is in a vertical orientation, the location of the salt pool is close to the top of the lamp. This objective can be achieved by making sure that the coldest spot is located close to the top of the lamp.

Figure 5:
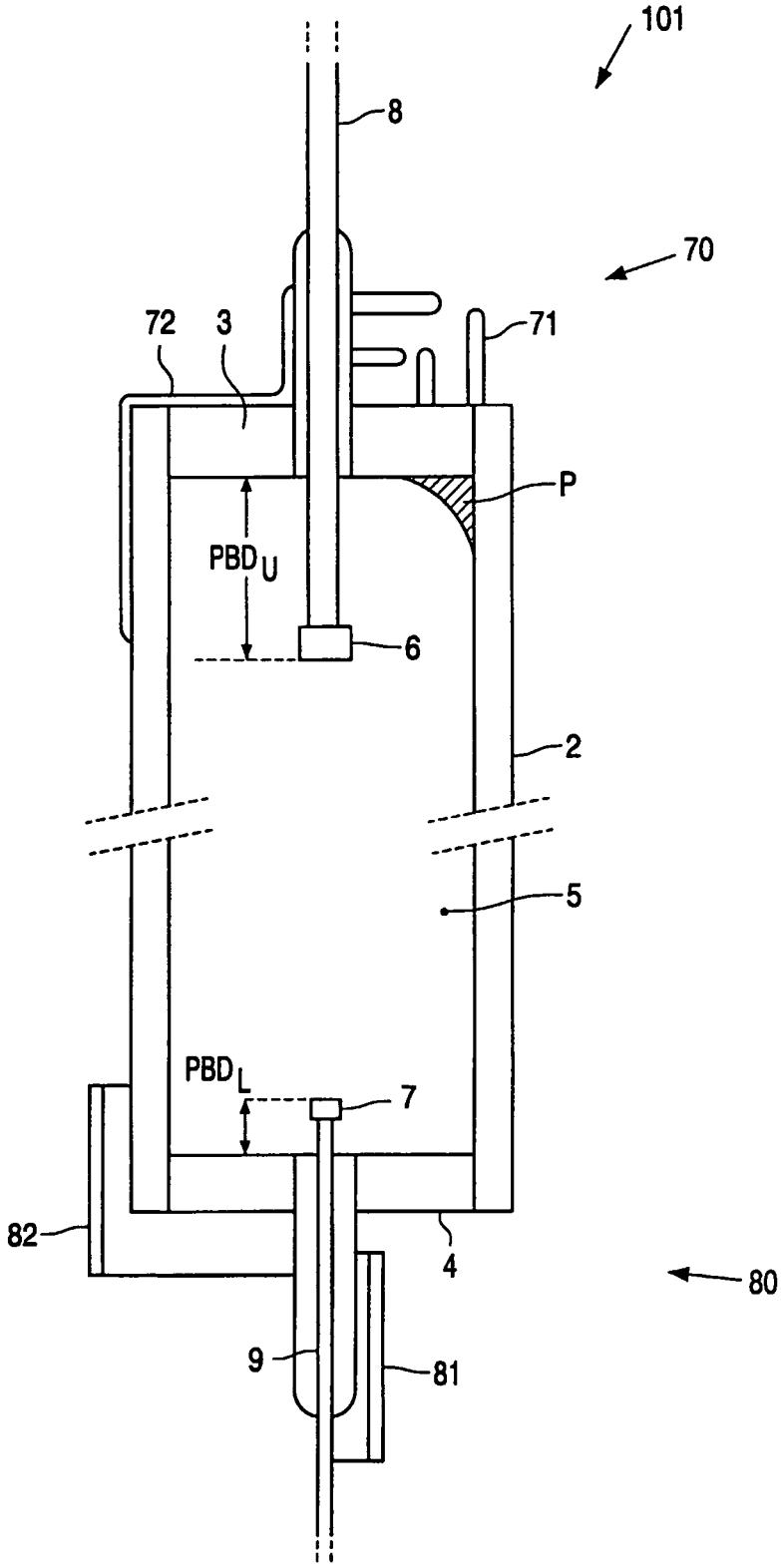
FIG. 5 is a schematical cross-section, comparable to FIG. 1 but on a larger scale than FIG. 1, of a lamp with a salt pool located close to the top.

As will be clear to a person skilled in the art, the discharge chamber 5 contains an excess amount of metal halides, such that during operation a pool P of melted salt will always be present inside the discharge chamber 5. FIG. 4 relates to the conventional situation where the salt pool P is located close to the bottom of the discharge chamber 5 when the lamp is in a vertical orientation, as shown in FIG. 1. FIG. 5 is a view similar to FIG. 1, showing a lamp 101 with a salt pool P located close to the top of the discharge chamber 5. As mentioned hereinabove, segregation causes the particle concentration to decrease as the height increases (i.e. increasing vertical distance from the bottom of the discharge chamber). However, in this case, where the particle concentration close to the top electrode 6 is approximately the same as in the horizontal situation, this means that the particle concentration increases as the distance from the salt pool increases.

Figure 6:
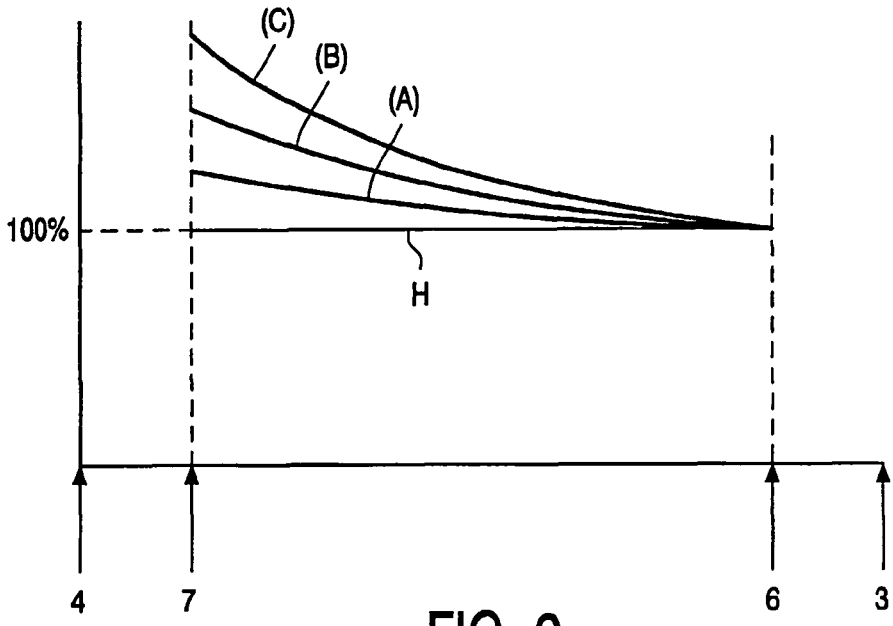
FIG. 6 is a graph comparable to FIG. 4, illustrating the particle distribution along the central axis of a lamp in its vertical orientation, for a lamp with a salt pool located at the top.

This effect is illustrated in FIG. 6, which is a graph similar to FIG. 4, but which now relates to the lamp 101 of FIG. 5. FIG. 6 clearly shows that, with respect to the horizontal orientation of the lamp 101 (horizontal line H), the particle concentration has increased at all locations along the axis of the lamp, the increase being larger at lower locations. This means that the efficacy of the lamp has increased: even if the current intensity remains the same, the overall amount of particles has increased, hence the overall amount of light generated, which depends on the overall amount of particles, has increased.

On the other hand, it is possible to generate the same amount of light at a reduced current magnitude, resulting in a lower temperature in the lamp and thus an increased life expectency of the lamp.

In fact, it is possible to achieve both: increased light output and increased lifetime.

In the following, some examples will be discussed of design modifications for achieving the desired effect of having a salt pool located at the top of the discharge chamber. However, it is noted that the present invention is not restricted to those examples.

The following examples have in common that they result in a working temperature distribution inside the discharge chamber 5 such that, when the lamp is in a vertical orientation, the coldest spot is close to the top of the discharge chamber. In a first approach, this is achieved by an asymmetric design of the lamp.

As will be clear to a person skilled in the art, when the lamp has ignited, a very hot arc burns between the lamp electrodes 6, 7. This arc will heat its surroundings, including the walls of the discharge chamber 5. On the other hand, the hot discharge chamber will transport heat to its surroundings. In a steady-state condition, the local temperature at a certain location of the discharge chamber will be determined by the balance between local heat input and local heat output.

In a first category of embodiments, the lamp is designed such that the arc heats the ceiling or upper cap 3 of the discharge chamber to a lesser extent than the bottom or lower cap 4 of the discharge chamber. In a first embodiment, illustrated in FIG. 5, the point-to-bottom distance PBDL of the lower electrode 7 is less than the point-to-bottom distance PBDU of the upper electrode 6. Herein, the point-to-bottom distance PBD of an electrode is defined as the axial distance between the electrode tip and the corresponding wall from which the electrode projects.

By way of example, the point-to-bottom distance PBDL of the lower electrode 7 can be in the order of 0–5 mm, the actual value being suitably chosen in dependence on the dimensions of the discharge chamber. In an exemplary embodiment, the discharge chamber may have a diameter of 4 mm and a length of 36 mm.

In a second category of embodiments, the lamp 101 is designed such that heat output close to the ceiling or upper cap 3 of the discharge chamber is increased in comparison with heat output close to the bottom or lower cap 4 of the discharge chamber. In a second embodiment, one or more upper lamp components are designed such that their heat transportation capacity is larger than the heat transportation capacity of the corresponding lower lamp components. As is also illustrated in FIG. 5, the electrode conductor 8 of the top electrode 6 may be thicker than the electrode conductor 9 of the lower electrode 7. Also, the electrode conductor 8 of the top electrode 6 may be made from a material having a larger heat transportation capacity than the material of the electrode conductor 9 of the lower electrode 7. Also, the upper cap 3 may be thicker than the lower cap 4, and/or the upper cap 3 may be made from a material having a larger heat transportation capacity than the material of the lower cap 4.

In a third embodiment, the lamp 101 is provided with additional heat discharge means 70 located at the upper end of the lamp vessel 2. Such additional heat discharge means 70 may comprise, for instance, suitably configured fins 71, shown on the right-hand side in FIG. 5, and/or such additional heat discharge means 70 may comprise, for instance, a radiation layer 72, shown on the left-hand side in FIG. 5, which is designed to discharge heat by emitting radiation.

Other implementations of such additional heat discharge means 70 will be possible too.

In a third category of embodiments, the lamp 101 is designed such that the heat output close to the bottom or lower cap 4 of the discharge chamber is inhibited with respect to the heat output close to the ceiling or upper cap 3 of the discharge chamber. In a fourth embodiment, also illustrated in FIG. 5, the lamp 101 is provided with heat transfer inhibiting means 80 located at the lower end of the lamp vessel 2. Such heat transfer inhibiting means 80 may comprise, for instance, a heat shield 81 which is located next to the electrode conductor 9 of the lower electrode 7 and preferably surrounds this electrode conductor 9, said heat shield being shown on the right-hand side in FIG. 5. Such heat transfer inhibiting means 80 may also comprise, for instance, a heat shield 82 which is located next to a lower portion of the vessel 2 and preferably surrounds this lower portion, said heat shield being shown on the left-hand side in FIG. 5.

It is noted that the above means for deliberately establishing a cold spot located at the top of the lamp chamber are all associated with the lamp 1, also indicated as "burner". However, it is also possible that such means are associated with the bulb 11 and/or lamp supports 13, 14 of a lamp assembly 10. Particularly, such heat shields 81, 82 of the fourth embodiment may be fixed to the lamp supports 13, 14.

Figure 7:
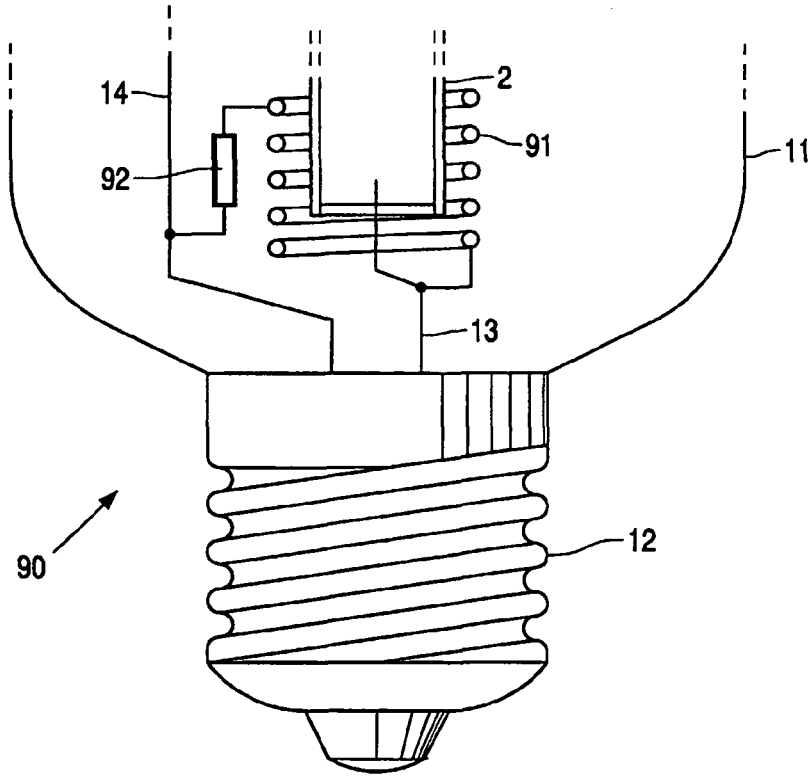
FIG. 7 is a partial cross-section of a lamp assembly with a radiator coil around a portion of the lamp.

In a fourth category of embodiments, a lamp assembly 10 is provided with additional heat generating means 90 located close to the lower end of the lamp vessel 2. In a fifth embodiment, illustrated in FIG. 7, such additional heat generating means 90 are embodied so as to be a radiation coil 91 which extends around a lower portion of the lamp vessel 2 and is fixed to the lamp supports 13, 14. Advantageously, the radiation coil 91 may also be powered by the lamp supports 13, 14, as is also illustrated in FIG. 7, which is achieved by electrically connecting one end of the radiation coil 91 to one lamp support 13 while the other end of the radiation coil 91 is electrically connected to the other lamp support 14. If desired, voltage reduction means may be provided, such as a series resistor 92, as is also shown in FIG. 7.

Although the present invention has been explained in the foregoing by descriptions of some exemplary embodiments, it should be clear to a person skilled in the art that the present invention is not limited to such embodiments; rather, various variations and modifications are possible within the protective scope of the invention as defined in the appending claims. For instance, in a particular embodiment, two or more, preferably all, of the temperature distribution modification means mentioned above are combined.

Furthermore, in the embodiment illustrated in FIG. 7, the lamp assembly 10 is intended for "cap down" orientation, i.e. the assembly is to be used with the cap 12 pointing down. Alternatively, in an assembly intended for "cap up" orientation, a heating coil will be arranged around that end of the lamp 1 which is farthest away from the cap 12.

The invention claimed is:

1. Metal halide lamp with an aspect ratio Li/Di greater than 3, comprising a discharge chamber having walls sealingly enclosing the discharge chamber; two electrodes arranged in the discharge chamber opposite each other, for burning an arc therebetween; the discharge chamber containing a saturated system comprising an excess amount of salt, such that during operation of the lamp, a salt pool of melted salt will be present inside the discharge chamber; the lamp being designed such that, when the lamp is operative in a vertical orientation, the location of the salt pool is closer to the top than the bottom of the discharge chamber.

2. Metal halide lamp according to claim 1, wherein the coldest spot is close to the top of the discharge chamber.

3. Metal halide lamp according to claim 1, wherein the lamp is operative in a vertical orientation, an arc heats the ceiling of the discharge chamber to a lesser extent than the bottom or lower cap of the discharge chamber.

4. Metal halide lamp according to claim 3, wherein the lower electrode has a point-to-bottom distance that is smaller than the point-to-bottom distance of the upper electrode.

5. Metal halide lamp according to claim 4, wherein the lower electrode has a point-to-bottom distance within the range of 0–5 mm.

6. Metal halide lamp according to claim 1, wherein the lamp is designed such that heat output close to the ceiling of the discharge chamber is greater than the heat output close to the bottom of the discharge chamber.

7. Metal halide lamp according to claim 6, wherein one or more upper lamp components are designed such that their heat transportation capacity is larger than the heat transportation capacity of the corresponding lower lamp components.

8. Metal halide lamp according to claim 6, further comprising electrode conductors sealingly extending through wall sections of the discharge chamber, wherein the electrode conductor of the top electrode is thicker than the electrode conductor of the lower electrode.

9. Metal halide lamp according to claim 6, further comprising electrode conductors sealingly extending through wall sections of the discharge chamber, wherein the electrode conductor of the top electrode is made from a material having a larger heat transportation capacity than the material of the electrode conductor of the lower electrode.

10. Metal halide lamp according to claim 6, wherein a wall section of the discharge chamber close to the top electrode is thicker than a wall section of the discharge chamber close to the lower electrode.

11. Metal halide lamp according to claim 6, wherein a wall section of the discharge chamber close to the top electrode is made from a material having a larger heat transportation capacity than the material of a wall section of the discharge chamber close to the lower electrode.

12. Metal halide lamp according to claim 6, wherein the lamp is provided with additional heat discharge means located at the upper end of the discharge chamber.

13. Metal halide lamp according to claim 12, wherein said additional heat discharge means comprise suitably configured fins, and/or wherein said additional heat discharge means comprise a radiation layer.

14. Metal halide lamp according to claim 6, wherein the lamp is provided with heat transfer inhibiting means located at the lower end of the discharge chamber.

15. Metal halide lamp according to claim 14, wherein said heat transfer inhibiting means comprise a heat shield which is located close to the electrode conductor of the lower electrode and preferably surrounds this electrode conductor, and/or wherein said heat transfer inhibiting means comprise a heat shield which is located close to a lower portion of the discharge chamber and preferably surrounds this lower portion.

16. Metal halide lamp of claim 1, wherein the lamp is provided with additional heat generating means located close to one end of the discharge chamber.

17. Metal halide lamp of claim 16, wherein said additional heat generating means comprises a radiation coil.

18. Metal halide lamp of claim 17, comprising a pair of electrically conductive lamp supports supporting the lamp and supplying power to the lamp, wherein the radiation coil is also powered by the said lamp supports.

* * * * *